US006112832A

United States Patent [19]

Muuttonen et al.

[11] Patent Number: 6,112,832

[45] Date of Patent: Sep. 5, 2000

[54] METHOD AND APPARATUS FOR CONTROLLING A ROCK DRILL ON THE BASIS OF SENSED PRESSURE PULSES

[75] Inventors: Timo Muuttonen, Siuro; Timo Kiikka, deceased, late of Tampere, by Sirkku Kiikka, heir; Jorma Mäki, Mutala, all of Finland

[73] Assignee: Sandvik Aktiebolag, Sandviken, Sweden

[21] Appl. No.: 09/268,732

[22] Filed: Mar. 17, 1999

[30] Foreign Application Priority Data

Mar. 17, 1998 [FI] Finland ..... 980586

[51] Int. Cl.[7] ..... E21B 47/12

[52] U.S. Cl. ..... 175/40

[58] Field of Search ..... 91/514, 516, 517, 91/518; 60/425, 483; 175/40, 45, 53, 61, 325.3, 135; 173/2, 212, 210, 105

[56] References Cited

U.S. PATENT DOCUMENTS 5,255,590 10/1993 Klemm ..... 91/516

5,351,763 10/1994 Muuttonen .

5,479,996 1/1996 Jönsson et al. .

5,833,015 11/1998 Hesse et al. ..... 175/40

*Primary Examiner*—Robert E. Pezzuto

*Attorney, Agent, or Firm*—Burns, Doane, Swecker & Mathis, L.L.P.

[57] ABSTRACT

During the drilling of rock by a rock drill bit, percussive impacts are applied to the drill bit by a reciprocating piston which impacts a shank that transmits the impacts to the drill bit. Secondary pistons are provided to push the shank forwardly in response to a pressure medium acting on rear surfaces of the secondary pistons. The secondary pistons push the shank to its optimum point of impact. During a drilling operation, as the piston applies percussive impacts, return pulses are reflected back to the secondary pistons. Pressure sensors detect the return pulses in the form of pressure pulses, which indicate whether the drill bit has encountered weaker or stronger materials. Based upon characteristics of the detected pressure pulses, the operation of the drilling machine, e.g., the feed and/or impact power thereof, is regulated, so that the shank is returned to its optimum point of contact.

13 Claims, 1 Drawing Sheet

METHOD AND APPARATUS FOR CONTROLLING A ROCK DRILL ON THE BASIS OF SENSED PRESSURE PULSES

BACKGROUND OF THE INVENTION

The invention relates to a method and apparatus for controlling a rock drill in a drilling machine comprising a frame, a percussion piston provided in the frame and moving in the longitudinal direction thereof, a shank placed on an axial extension of the percussion piston, and at least one piston that is provided in the frame movably in the axial direction thereof, the piston being arranged to act on the shank to push it towards the front of the drilling machine due to a pressure medium acting on the rear surface of the piston, whereupon at least during the drilling the pressure of said pressure medium is such that the combined force of all the pistons acting on the shank and pushing it forward exceeds the feed force acting on the drilling machine during the drilling, so that as the shank rests on all the pistons it is situated at its optimum point of impact, in which method the pressure of said pressure medium acting on the shank is measured.

When holes are drilled in rock with a rock drill, the conditions of drilling vary in different ways. Rock consists of layers of rock material with different degrees of hardness, wherefore the properties affecting the drilling, such as impact power and feed, should be adjusted according to the current drilling resistance. Otherwise the drilling is irregular since the drill propagates rapidly in a soft material and slowly in hard rock. This brings about several problems concerning for example the endurance of the drilling apparatus and the controllability of the drilling process. One example of solving these problems relates to adjusting the impact power of the drilling machine by transferring an impact-transmitting shank forward from the optimum point of impact in the longitudinal direction when a lower impact power is to be transmitted from the percussion piston to the shank. The shank is moved by means of hydraulically operated pistons, which support the shank from behind either directly or via a sleeve. When the pressure of a pressure medium acting in a cylinder space situated behind the pistons is changed, it is possible to adjust the length of movement of the pistons and thus the position of the shank-In this manner, it is possible to transmit a desired amount of capacity via the shank to the drill rod, whereas the rest of the impact is dampened by a damping pad provided at the front end of the percussion piston. Such an arrangement is disclosed in Finnish Patent 84,701.

Finnish Patent Application No. 944,839 discloses a known manner of controlling the drilling capacity of a rock drilling apparatus, wherein the aim is to prevent the occurrence of damage to the drill. The reference discloses that when the drilling machine hits an area where the drilling resistance is smaller and the drill thus penetrates more easily into the rock, the drilling is continued normally except that the operation of the percussion apparatus is stopped completely until the material under operation gets harder and the drilling requires percussion again. The apparatus comprises a piston of a return damper, which moves in the direction of the percussion piston with respect to the frame of the drilling machine and which is able to move forward towards the drill bit when the drilling resistance is temporarily smaller. This leads to a decrease in pressure in the chamber behind the piston, If the pressure falls below a predetermined pressure level, a valve stops the supply of pressure medium to the percussion apparatus, whereupon the percussion piston will not deliver any more blows. When the drill again hits again hard rock and the pressure in the chamber behind the piston exceeds a predetermined pressure limit, the connection to the percussion apparatus is opened and the percussion piston begins to deliver impacts again.

However, the aforementioned prior art arrangements have proved to be insufficient for the efficient and accurate control of drilling machines. They only affect the control of the impact force but they do not provide means for adjusting and controlling the drilling in more various manners. They also cause loss of power, which means that hydraulic pumps, pipes and other hydraulic components must be made unnecessarily large.

The purpose of the present invention is to provide a better and more versatile method and apparatus for controlling the operation of a drilling machine than previously.

SUMMARY OF THE INVENTION

The method according to the invention is characterized in that a pressure sensor measures a return pulse which is reflected back to the drilling apparatus from the rock to be drilled and which results from the impact of the percussion piston, the return pulse being detected as a pressure pulse when the pressure in the space behind the piston is measured by means of the pressure sensor, and that the measurement data of the reflected pressure pulse is used for controlling the operation of the drilling machine.

Further, the apparatus according to the invention is characterized in that a pressure sensor measures a return pulse which is reflected back to the drilling apparatus from the rock to be drilled and which results from the impact of the percussion piston, the return pulse being detected as a pressure pulse when the pressure in the space behind the piston is measured by means of the pressure sensor, and that the measurement data of the reflected pressure pulse is used for controlling the operation of the drilling machine.

A basic idea of the invention is that a pressure sensor is used to measure pressure pulses in a pressure chamber situated behind one or more pistons supporting the shank from behind. When the feed resistance at the drill bit decreases, the point of impact starts to move forward from the optimum point of impact. This means that at least some of the energy of the percussion piston is dampened. Correspondingly, a return pulse that is formed in a softer material is weaker, wherefore the resulting pressure pulse is smaller and possibly shorter than in a normal situation. Instead of two or more pistons, it is also possible to use a single piston, which supports the shank by means of the pressure of the pressure medium. In such a case, measurement is carried out from the pressure chamber of this single annular piston. Absence of pressure pulses or changes in normal values are detected as a situation that deviates from a normal drilling operation by the pressure sensor that is arranged to measure the pressure in the chambers behind the piston(s). The measurement data of the pressure sensor is supplied to the control system of the drilling machine, which then adjusts on the basis of this data the operation of the drill, for example the drilling parameters, which include feed pressure and impact pressure. The power of the drilling is adjusted until the optimum point of impact is reached again.

The invention has an advantage that it is now possible to adjust the impact capacity of the drilling machine and the other drilling parameters in an economical and efficient manner suitably in each situation. The drilling process can now be measured during the drilling and the obtained data can be utilized in several ways to control the drilling. It is also easier to control special situations than previously. The apparatus according to the invention also enables the detection and storage of the properties of different layers of the hole to be drilled in a control unit for later use. On the basis of this data, it is possible, for example, to plan the drilling at the destination and to chart the properties of the rock. It is further possible to use the pressure pulses provided by the pressure sensor to draw conclusions about the condition of the drill bit and to use the measurement data in fault diagnostics. Another advantage is that the arrangement according to the invention decreases the need for power of the drilling apparatus, which in turn decreases the costs. The present arrangement can also be connected to existing devices in a rather simple manner.

BRIEF DESCRIPTION OF DRAWING

The invention will be described in greater detail in the accompanying drawing, in which.

DETAILED DESCRIPTION OF PREFERRED EMBODIMENTS

Figure 1:
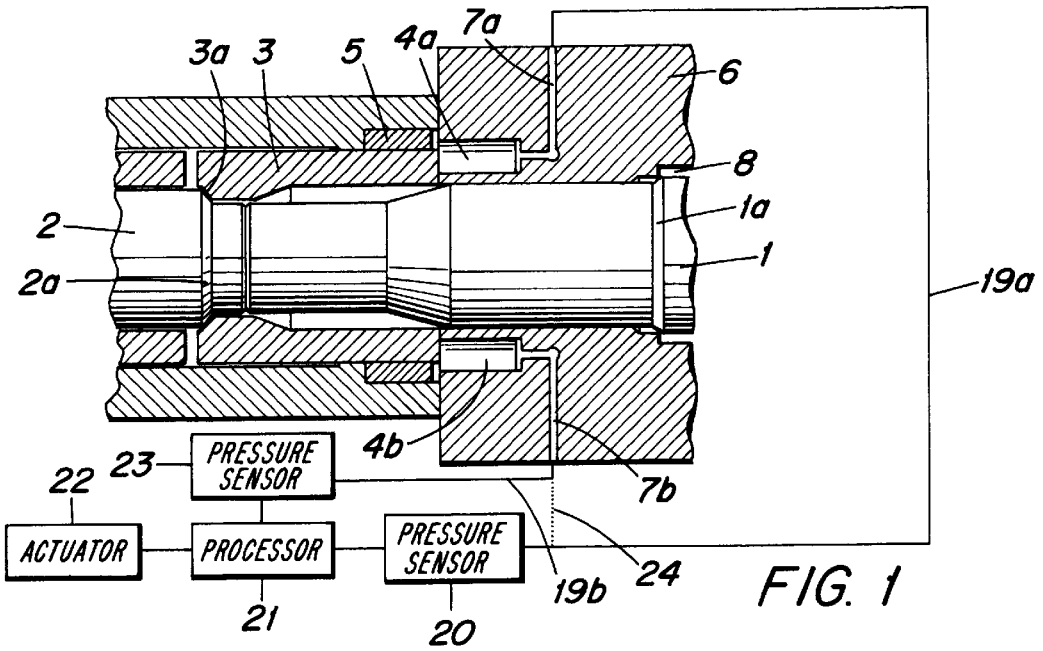
FIG. 1 shows schematically, in a partial section, the front end of a rock drill according to the invention.

FIG. 1 shows schematically, in a partial section, the front of a rock drill. The drilling machine comprises a percussion piston 1 and a coaxially positioned shank 2, which receives impacts delivered by the percussion piston. The impact force is transmitted via drill rods, that are usually placed as an extension of the shank, to a drill bit (not shown) that strikes the rock and breaks it. The impact operation of the percussion piston 1 is not discussed in greater detail in this connection since it is generally known in the field and evident to a person skilled in the art. The shank 2 is usually rotated by means of a rotary motor known per se by turning a rotary sleeve that is provided around the shank 2, which is able to move axially with respect to the sleeve. Both the structure and operation of the rotary motor and the rotary sleeve are fully known to a person skilled in the art, wherefore they will not be discussed in greater detail herein.

Further, around the rear of the shank 2 there is a separate supporting sleeve 3 which supports the shank 2 during the drilling. The supporting sleeve 3 supports the shank 2 by means of a sloping support surface 3*a*, which comes into contact with a corresponding sloping support surface 2*a* in the shank 2. Behind the supporting sleeve 3 there are several secondary pistons 4*a* and 4*b* which are connected to or which act indirectly mechanically on the rear surface of the supporting sleeve 3. Around the supporting sleeve 3 there may also be a stop ring 5, which restricts the movement of the pistons 4*a* and 4*b* towards the front of the drilling machine.

The pistons 4*a* and 4*b* are situated in cylinder spaces which are formed in a frame 6 or in a separate cylinder section and which are parallel to the axis of the percussion piston 1, and pressure fluid ducts 7*a* and 7*b* lead to the cylinder spaces. Such a pressure of the pressure medium is applied at the rear surface of the pistons 4*a*, 4*b* at least during the drilling, whereby the combined force of the pistons acting on the shank 2 and pushing it forward exceeds the feed force acting on the drilling machine during the drilling. There are several pistons 4*a* and 4*b* in the frame 6 of the drilling machine and they are preferably divided into at least two separate groups which have different lengths of movement towards the front end of the drilling machine. The drilling machine further comprises a conventional absorber 8 at the front of the cylinder space of the percussion piston 1 or over the distance of motion of a piston part 1*a* of the percussion piston 1 at the front of the drilling machine. The front of the piston part 1*a* of the percussion piston 1 delivers an impact at this absorber when the percussion piston 1 strikes past its normal optimum point of impact for some reason. Such a structure is known per se and therefore it will not be described in greater detail.

The apparatus further comprises measuring conduits 19*a* and 19*b*, which are preferably connected to the ducts 7*a*, 7*b* such that a pressure pulse acting behind the pistons 4*a* can be measured by means of a pressure sensor 20 connected to the measuring conduit 19*a*. This is the simplest arrangement, but naturally it is also possible to provide a separate bore in the frame 6 for the pressure sensor 20. Measurement data is supplied electrically from the pressure sensor 20 to a control unit 21, where the data can be processed. If required, the control unit 21 transmits a control signal to an actuator 22, which may be, for example, an actuator adjusting the feed or a valve adjusting the pressure of the percussion apparatus, or both. It is possible to supply to the control unit 21 a great deal of different measurement data concerning the drilling process, so that the control unit 21 can control the operation of the drilling machine suitably in each situation on the basis of the data. The FIG. also shows a second pressure sensor 23 which measures the pressure behind the other pistons 4*b*, the pressure sensor 23 being correspondingly connected to the control unit 21. It is thus possible to measure a pressure pulse either separately from the pistons 4*a* or 4*b*, or together from both pistons. It is also possible to use only one pressure sensor 20 or 23, in which case the ducts 7*a* and 7*b* of the pistons 4*a* and 4*b* would be connected together as shown by a broken line 24, which means that the second pressure sensor 20 or 23 would not be needed. In practice, a pressure pulse can be measured in a relatively simple manner merely from behind the pistons 4*a*, which means that the pistons 4*a* and 4*b* are situated in different pressure circuits. This is based on the fact that since the pistons 4*a* may move towards the front of the drilling machine only to a position that corresponds to the optimum point of impact of the shank, pressure pulses are only produced when the shank moves towards the rear of the drilling machine at such a force that it moves past its optimum point of impact. When pressure pulses are measured in such a manner, they provide preferably reliable basic information for implementing the control.

Figure 2A:
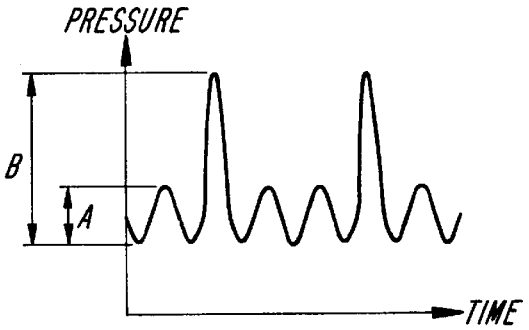
FIGS. 2*a* and 2*b* show schematically pressure curves measured from a space behind pistons.

FIG. 2*a* shows schematically a normal pressure curve that has been measured from the space behind the pistons. When the drilling resistance of the rock to be drilled is normal and the pistons have moved the shank to the optimum point of impact, the percussion piston delivers an impact at full force at the shank, from which the impact is transmitted further to the drill rods and thus also to the drill bit. As the drill bit hits the hard rock, it produces a return motion that is reflected backwards and transmitted via the drill rods to the shank. Since the shank is stressed by means of the supporting sleeve 3 and the pistons pushing it forward, the tension that is reflected from the rock is also transmitted to the pistons, which therefore move backwards in their cylinder spaces as a result of this reflected pulse. The backward movement of the pistons produces a rapid increase in pressure, in other words a return pulse, in the space behind the pistons. This can be seen in FIG. 2*a* as a pressure pulse B, which is clearly distinguishable from the average pressure level. The occurrence of this pressure pulse B in the pressure curve is monitored specifically. The pressure pulses B are always greater than the average pressure level. At least the power, amplitude, rate of rise and frequency of occurrence of the pressure pulse can be utilized for controlling the drilling. Pressure pulses A which are shown in the FIG. and which are smaller than the pressure pulses B result from variations in the pressure of the pressure fluid when the pistons 4*a* and 4*b* are subjected to the pressure in the pressure duct of the percussion apparatus. If the pressure fluid supplied to the cylinder space of the pistons to be measured were conveyed from a separate pressure source or via a pressure duct that is separate from the percussion conduit, there would be no pressure pulse A resulting from the impact operation; rather, the average pressure curve would be substantially even.

Figure 2B:
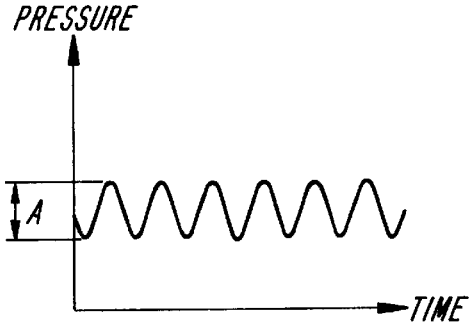

FIG. 2*b*, in turn, shows a pressure curve which entirely lacks pressure pulses B. The curve only shows pressure variation A that results from changes in the pressure of the impact circuit. The absence of the pressure pulse B or the weakness of the pulse is due to the fact that the drill bit has penetrated into a soft rock material at a normal drilling power, which means that for a while the drill operates faster than usual. The shank has thus moved forward from the optimum point of impact, wherefore the absorber of the percussion piston receives at least a part of the impact. Since the power of the impact is diminished in this manner, the drill bit does not strike the rock at such a great force nor does it produce a similar recoil as in a normal drilling situation or a resulting return pulse. On the other hand, a soft rock material does not resist an impact to the same extent as a hard material, and therefore it does not cause a similar return pulse in the drilling equipment.

Figure 3:
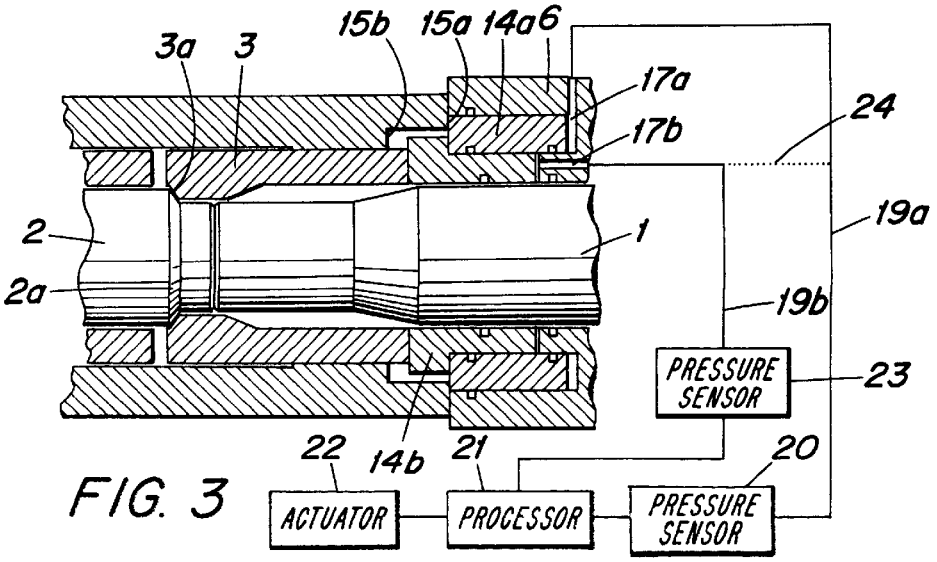
FIG. 3 shows schematically, in a partial section, another embodiment of a drilling machine according to the invention.

FIG. 3 shows yet another embodiment of the front end of a drilling machine according to the invention in a partial section. The reference numerals correspond to those of FIG. 1. The arrangement shown in the FIG. corresponds otherwise to the arrangement of FIG. 1 except that in FIG. 3 several separate pistons are replaced with sleeve-like pistons, which are placed coaxially around the percussion piston 1. In this case, the pistons 14*a* and 14*b* are placed such that the piston 14*a* is situated in the outermost position and a pressure duct 17*a* is connected to the piston 14*a* so that it can push the piston forward all the way to a mating surface 15*a*. The piston 14*b* is in turn located coaxially inside the piston 14*a*, and pressure fluid is supplied behind the piston 14*b* along a duct 17*b* . When the piston 14*b* rests against a mating surface 15*b*, the shank 2 is pushed forward to a new position that differs from the optimum point of impact. As shown already in FIG. 1, the pressure is measured from the space behind either both the pistons 14*a*, 14*b* or only the pistons 14*a*. The ducts 17*a* and 17*b* are connected to a measuring conduit 19*a*, which is provided with a pressure sensor 20 that measures the reflected pressure pulse. Correspondingly, the duct 17*b* is connected to a measuring conduit 19*b*, which is provided with a pressure sensor 23 that measures the reflected pressure pulse. As regards the measurement and use of the pressure pulse, the situation is similar as in FIG. 1. Similarly, it is also possible in this embodiment to measure the pressure pulse with only one sensor, which means that the ducts 17*a* and 17*b* are connected to the measuring conduit 19*a* as shown by a broken line 24, and the pressure sensor 23 is not needed.

The drawing and the related description are only intended to illustrate the inventive idea. The details of the invention may vary within the scope of the claims. For example, the structure of the drilling machine does not have to be identical to the one shown in the figures, but for instance the damping of the percussion piston can be arranged in some other manner. Further, the pistons can be arranged to act directly on the shank, which means that no separate sleeve is necessarily needed between the shank and the pistons. An axial bearing may be provided between the shank and the pistons and it is positioned coaxially with the shank and the percussion piston. The analysis and use of the measurement signal obtained from the pressure sensor may also employ signal processing methods, which enable the extraction of more varied data from the measurement signal concerning, for example, the duration, energy and frequency of the reflected pulse, and this measurement data can then be used to effectively control the drilling machine.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A method for measuring pulses acting against a drill bit during the drilling of rock by a drilling machine comprising a frame, a percussion piston provided in the frame and reciprocable in a longitudinal direction thereof, a shank arranged in front of the piston to receive percussive impacts therefrom, and a secondary piston arrangement comprising at least one secondary piston that is provided in the frame movably in the axial direction thereof, the secondary piston arrangement arranged to act forwardly on the shank to push the shank forwardly in response to a pressure medium acting on a rear surface of the secondary piston, whereby during the drilling the pressure of said pressure medium is such that the total force of the secondary piston arrangement acting on the shank and pushing it forward exceeds the feed force acting on the drilling machine during the drilling, so that as the shank rests against the secondary piston arrangement it is situated at its optimum point of impact, the method comprising the steps of:

A) imparting percussive impacts from the percussion piston to the shank during a rock drilling operation to cause return pulses to be reflected back to the secondary piston arrangement, while the secondary piston is acted upon by the pressure medium;

B) measuring a pressure of the pressure medium behind the secondary piston arrangement during step A; and C) detecting the return pulses in the form of pressure pulses sensed in the pressure medium during step B.

2. The method according to claim 1, further comprising the step of adjusting an operation parameter of the drilling machine on the basis of a strength of the sensed pressure pulses.

3. The method according to claim 1, further comprising the step of adjusting an operation parameter of the drilling machine on the basis of an amplitude of the sensed pressure pulses.

4. The method according to claim 1, further comprising the step of adjusting a feed of the drilling machine on the basis of the sensed pressure pulses.

5. The method according to claim 4 wherein the feed is adjusted in response to the sensed pressure pulse varying from a reference value.

6. The method according to claim 4 further comprising the step of adjusting an impact power of the drilling machine on the basis of the detected pressure pulses.

7. The method according to claim 1 further comprising the step of adjusting an impact power of the drilling machine on the basis of the detected pressure pulses.

8. The method according to claim 7, wherein the impact power is adjusted in response to the sensed pressure pulse varying from a reference value.

9. The method according to claim 1 wherein a front end of the secondary piston abuts the shank during steps A and B, and step C is performed at a location behind the secondary piston arrangement.

10. A rock drilling machine comprising:

a frame;

a percussion piston disposed in the frame and reciprocable in a longitudinal direction of the frame;

a shank arranged to receive percussive impacts from the percussive piston;

a secondary piston arrangement comprising at least one secondary piston disposed in the frame and movable in the longitudinal direction to push the shank forwardly in response to a pressure medium acting on a rear surface of the secondary piston arrangement, whereby a total forward force of the secondary piston arrangement acting on the shank exceeds a feed force acting rearwardly on the drilling machine during a drilling operation, the secondary piston arrangement positioned such that the shank is situated at an optimum impact-receiving position when resting against the secondary piston arrangement; and a pressure sensor for measuring a pressure of the pressure medium behind the secondary piston arrangement during impacts of the percussive piston, whereby return pulses reflected back to the secondary piston form pressure pulses in the pressure medium and are sensed by the pressure sensor.

11. The rock drilling machine according to claim 10 further including a control unit connected to the pressure sensor for adjusting a feed of the drilling machine on the basis of the sensed pressure pulses.

12. The drilling machine according to claim 11 wherein the control unit is operable to adjust an impact power of the drilling machine on the basis of the sensed pressure pulses.

13. The drilling machine according to claim 10 further including a control unit connected to the pressure sensor for adjusting an impact power of the drilling machine on the basis of sensed pressure pulses.

* * * * *